US006147654A

United States Patent [19]

Nagy

[11] Patent Number: 6,147,654

[45] Date of Patent: Nov. 14, 2000

[54] AM DEFOGGER GROUNDING SYSTEM FOR VEHICLE WINDOW ANTENNAS

[75] Inventor: Louis Leonard Nagy, Warren, Mich.

[73] Assignees: General Motors Corporation, Detroit; Delphi Technologies, Inc., Troy, both of Mich.

[21] Appl. No.: 09/361,321

[22] Filed: Jul. 27, 1999

[51] Int. Cl.[7] ..... H01Q 1/32

[52] U.S. Cl. ..... 343/713; 343/704; 343/860

[58] Field of Search ..... 343/704, 711, 343/712, 713, 850, 858, 860

[56] References Cited

U.S. PATENT DOCUMENTS

| | | | |
|---|---|---|---|
| 5,528,314 | 6/1996 | Nagy et al. | 343/711 |
| 5,610,619 | 3/1997 | Zafar | 343/713 |
| 5,629,711 | 5/1997 | Matsuoka et al. | 343/704 |
| 5,641,558 | 6/1997 | Noda et al. | 428/210 |
| 5,739,794 | 4/1998 | Nagy et al. | 343/711 |
| 6,031,500 | 2/2000 | Nagy et al. | 343/713 |

*Primary Examiner*—Don Wong
*Assistant Examiner*—Thuy Vinh Tran
*Attorney, Agent, or Firm*—George A. Grove

[57] ABSTRACT

A backlite antenna system for a vehicle that includes a separated AM/FM antenna grid and a defogger grid. The backlite antenna system includes a defogger grid grounding system having an RF grounding strip that is capacitively coupled to the vehicle body through a urethane seal that seals the window to the vehicle body. The grounding strip and an end bar of the defogger grid create an FM slot gap therebetween and provide grounding at AM frequencies. An AM grounding line is connected to the grounding strip and to an element of the defogger grid. The grounding line has a length one-quarter of the wavelength of the FM transmission band to provide a high impedance path for FM frequencies, but a low impedance path for AM and DC frequencies. The grounding strip provides a high impedance path at DC, but a low impedance path at AM and FM frequencies.

17 Claims, 2 Drawing Sheets

AM DEFOGGER GROUNDING SYSTEM FOR VEHICLE WINDOW ANTENNAS

TECHNICAL FIELD

This invention relates generally to a vehicle antenna system and, more particularly, to a vehicle backlite antenna system including separated defogger elements and AM/FM antenna elements, and including an improved defogger grounding system for reducing AM noise interference.

BACKGROUND OF THE INVENTION

U.S. Pat. No. 5,610,619 issued to Safari Mar. 11, 1997, entitled "Backlite Antenna for AM/FM Automobile Radio Having Broadband FM Reception," discloses a backlite antenna system including a separate defogger grid and an AM/FM antenna grid. The antenna grid includes antenna elements that extend across the rear window of the vehicle that are connected by antenna end bars. A tuning stub that provides FM reception is connected to the antenna grid and is positioned between the antenna grid and the defogger grid. The defogger grid includes defogger elements that extend across the window and are connected by defogger end bars. The defogger grid is heated by applying a current to one of the end bars and grounding the other end bar.

The antenna elements and the defogger elements are not directly connected to each other, but are spaced apart so that the defogger elements are electromagnetically coupled to the antenna elements and are driven as a parasitic element. Since the defogger elements cover most of the viewing area of the rear window, the antenna elements are confined to an upper portion of the window. The vehicle body acts as a ground plane and is capacitively coupled to the antenna elements through a urethane seal that seals the rear window to a vehicle body flange. It is important to control the smallest distance between the antenna elements and the body metal ground plane to control the antenna impedance.

In this type of design, the defogger grid acts as a parasitic antenna element. The parasitic,element affects the antenna's vertically polarized FM reception characteristics. Improvements in the FM vertically polarized antenna characteristics are achieved by providing two vertical shorting bars near the center of the defogger grid. The shorting bars ground the center portion of the defogger grid to provide a consistent ground plane across the entire width of the defogger grid.

The defogger grid also causes AM noise to be received by the antenna elements. The AM noise results from the defogger grid current and vehicle generated noise. This noise is reduced by using the existing DC ground for the defogger grid current connected to one side of the defogger grid. In one design, this is a long wire connected to one end bar of the defogger grid and vehicle ground. Additionally, an RF ground circuit is connected to the other end bar of the defogger grid, and includes a capacitor connected to this end bar and vehicle ground. This additional RF grid ground provides a low impedance path at AM and FM frequencies and a high impedance path at DC. The RF ground circuit needs to provide a very high DC impedance path so that it will not shunt to ground the defogger grid current and defeat the purpose of the defogger grid.

Although the separated AM/FM antenna grid and defogger grid have been successful in providing AM/FM reception and performance, improvements can be made to reduce costs, improve noise reduction, and provide improved FM impedance matching. For example, the costs involved in providing and installing the RF ground circuit can be reduced or eliminated. It is an object of the present invention to provide a vehicle backlite antenna system including an improved RF ground circuit.

SUMMARY OF THE INVENTION

In accordance with the teachings of the present invention, a backlite antenna system for a vehicle is disclosed that includes a separated AM/FM antenna grid and defogger grid. The backlite antenna system includes a defogger grid grounding system having an RF grounding strip formed on the window that is positioned between an antenna end bar and an edge of the window. The RF grounding strip is capacitively coupled to the vehicle body through a urethane seal that seals the window to the vehicle body. The capacitively coupled RF grounding strip provides a low impedance path for RF frequencies and a high impedance path at DC. The grounding strip and the end bar create a slot gap at RF frequencies. An AM grounding line is also connected to the end bar and a defogger grid element. The AM grounding line has a length of one-quarter of a wavelength of the FM band to provide a high impedance path for FM frequencies but a low impedance path for AM frequencies. Thus, the RF coupled grounding strip and the AM grid grounding line will act as a low impedance grounding path for the defogger grid at AM frequencies but a high impedance path at DC and FM frequencies Additional objects, advantages and features of the present invention will become apparent from the following description and appended claims, taken in conjunction with the accompanying drawings.

DESCRIPTION OF THE PREFERRED EMBODIMENT

The following discussion of the preferred embodiments directed to an AM defogger grounding system for a vehicle window antenna is merely exemplary in nature and is in no way intended to limit the invention or its applications or uses.

Figure 1:
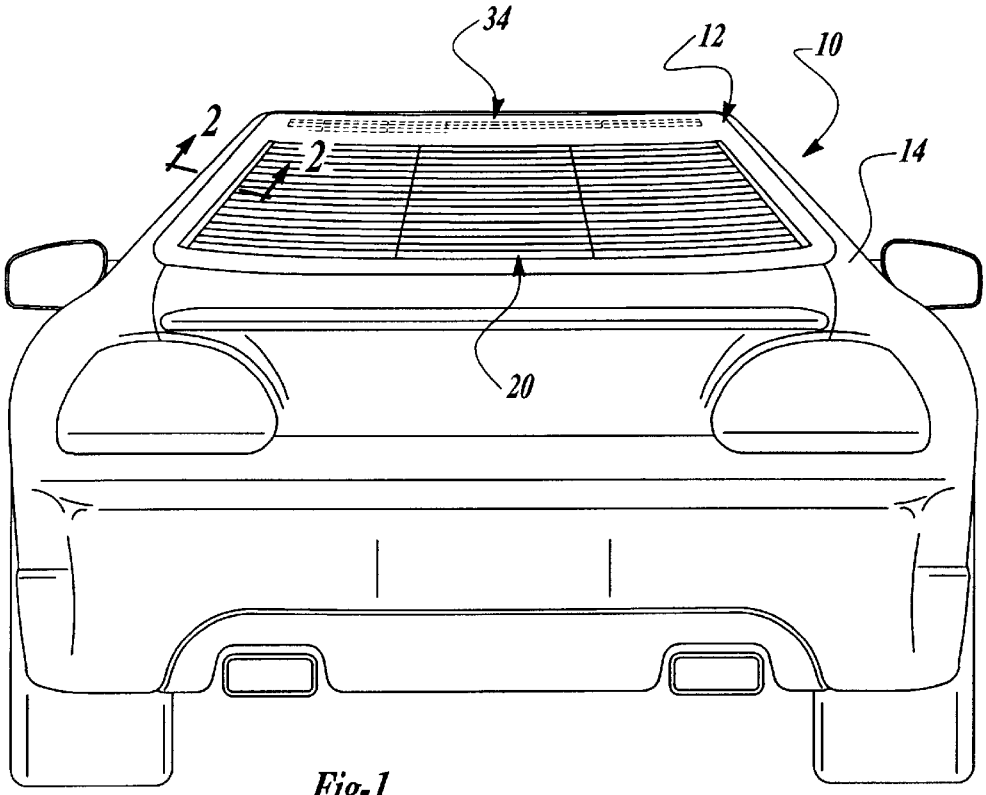
FIG. 1 is a back view of a vehicle incorporating a backlite antenna system, according to an embodiment of the present invention.
Figure 2:
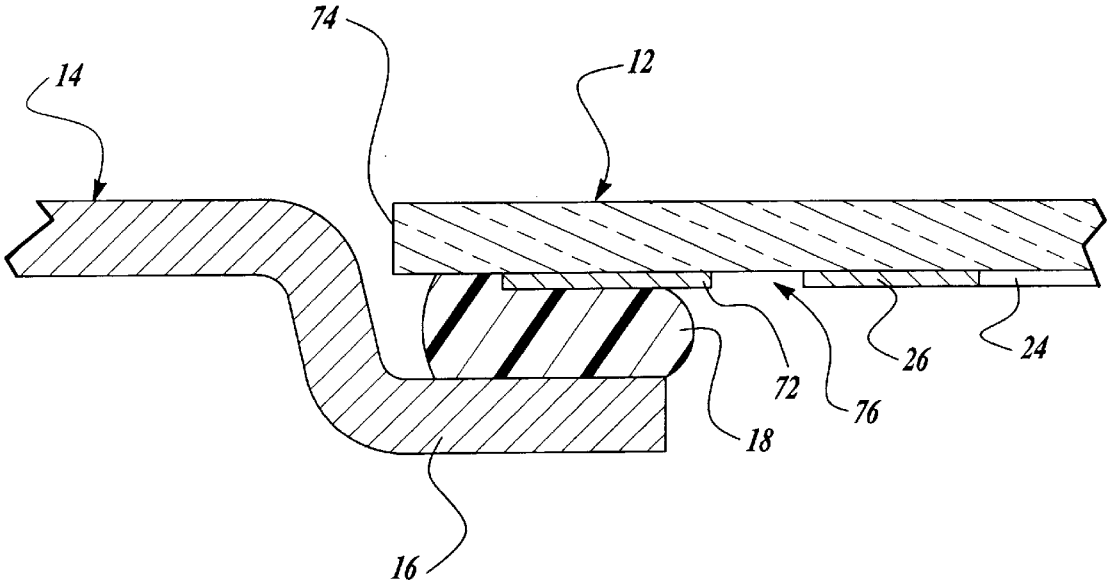
FIG. 2 is a cross-sectional view of the vehicle where the rear window is attached to a vehicle body panel.

FIG. 1 is a back view of a vehicle 10 including a rear window 12 or backlite. FIG. 2 is a cross-sectional view through line 2—2 in FIG. 1. The rear window 12 is mounted within an opening of a vehicle body panel 14. The body panel 14 includes a recessed flange 16 extending into the opening. A urethane seal strip 18 is provided on the flange 16 around the opening. The window 12 is placed on the urethane strip 18 to seal it to the flange 16. The urethane strip 18 has electrically conductive properties at radio frequencies due to its dielectric constant and the electrically conductive particles included therein to provide a black color. A suitable molding (not shown) is then placed around the edge of the window 12 between the vehicle body panel 14 and the window 12 for aesthetic purposes. Backlite mounting of this type is well understood to those skilled in the art.

Figure 3:
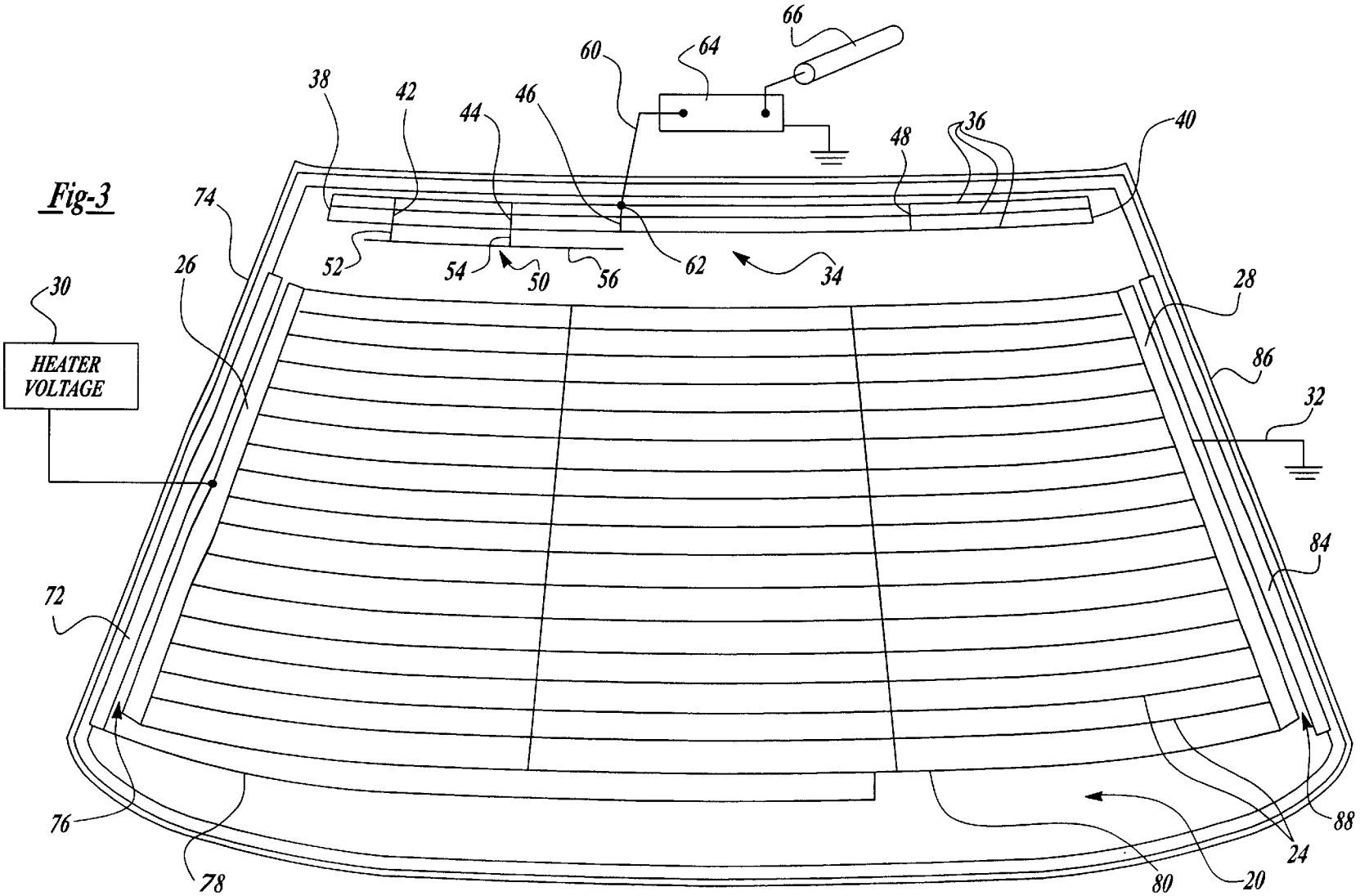
FIG. 3 is a diagrammatic plan view of AM/FM antenna grid and a defogger grid in the rear window of the vehicle of FIG. 1, according to the invention.

FIG. 3 is a diagrammatic plan view of the rear window 12 separated from the vehicle 10. A defogger grid 20 is formed on an inside surface at a bottom portion of the rear window 12. The defogger grid 20 includes a plurality of parallel, equally spaced grid elements 24. The grid elements 24 are connected at each end by two opposing defogger bus bars 26 and 28. The elements 24 and the bus bars 26 and 28 of the defogger grid 20 are made of a conductive frit material that is deposited and patterned on an inside surface of the window 12 and are responsive to electrical signals. An electrical current is applied from a heater circuit 30 to the grid 20 through the bus bar 26 to heat the elements 24 and thus the window 12. The bus bar 28 is connected to vehicle ground through the body panel 14 by DC grounding wire 32.

An antenna grid 34 is also formed on an inside surface of the rear window 12 above and separated from the defogger grid 20. The antenna grid 34 includes three horizontal, equally spaced antenna elements 36 extending across substantially the entire width of the window 12, as shown. The antenna elements 36 are electrically connected together at both ends by antenna element bus bars 38 and 40. The elements 36 and the bus bars 38 and 40 are also made of the conductive frit material. The antenna elements 36 are electrically connected together by four vertical antenna grid elements 42, 44, 46 and 48. Additionally, an FM tuning grid 50 including two vertical tuning elements 52 and 54 is connected to the vertical grid elements 42 and 44 and a tuning stub 56. The tuning stub 56 extends between the antenna grid 34 and the defogger grid 20, and provides suitable FM tuning reception in the FM frequency band for a particular vehicle body style.

An antenna pigtail 60 is connected to a feedpoint 62 of the antenna grid 34 and is connected to an AM/FM amplifier 64. A coaxial cable 66 is connected to the amplifier 64 and then connected to the vehicle radio (not shown). The antenna amplifier 64 includes an impedance matching network that impedance matches the output from the antenna grid 34 to the amplifier 64 to reduce the attenuation of power transferred from the antenna grid 34 to the amplifier 64. The operation of the defogger grid 20 and the antenna grid 34 as discussed above is known in the art.

To provide the necessary RF ground for the parasitic antenna element generated by the defogger grid 20, the present invention proposes providing an RF grounding strip 72 on an inside surface of the window 12 between the end bus bar 26 and a left side edge 74 of the window 12. The grounding strip 72 is also made of the conductive frit material and is patterned at the same time as the antenna grid 34 and the defogger grid 20. The RP grounding strip 72 provides capacitive coupling to the flange 16 through the urethane seal 18, where the seal 18 acts as a dielectric. The specialized grounding strip 72 provides the desired capacitive coupling. The grounding strip 72 has a length approximately equal to the length of the defogger bus bar 26. The urethane seal 18 has a high DC resistance, a very high dielectric constant and significant loss tangent at AM/FM frequencies. The grounding strip 72 and the vehicle body metal of the body panel 14 will thus form an effective RF capacitor circuit. The grounding strip 72 has a suitable width to define an FM slot gap 76 between the grounding strip 72 and the end bar 26 for a FM slot gap transmission line.

An AM grounding line 78 is connected to the RF grounding strip 72 and a lower grid element 80 of the defogger grid 20. In one embodiment, the length of the grounding line 78 is about one-quarter the wavelength of the center frequency of the FM band. Because the length of the grounding strip 78 is much less than the wavelength of the AM frequency band, it looks like an open circuit to the FM frequency band to transfer it from a ground impedance to an open circuit impedance. Therefore, it has a high impedance at FM frequencies and a low impedance at AM frequencies. This provides an AM ground for the defogger grid 20 to reduce the defogger noise without affecting the characteristics FM impedance matching of the defogger grid 20.

Additionally, a grounding strip 84 can be provided at an opposite side of the defogger grid 20 between the end bar 28 and a right side edge 86 of the window 12. The grounding strip 84 is also capacitively coupled to the vehicle body 14 through the urethane seal 18, and forms an FM slot gap 88 created between the end bar 28 and the strip 84. The FM slot gap helps give the defogger grid 20 an FM characteristic impedance for proper FM impedance matching. The defogger grid DC ground wire 32 has a length one-quarter the wavelength of the FM frequency band to provide low impedance ground path for DC and AM frequencies and a high impedance path for FM frequencies.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna system for a vehicle, said antenna system comprising:

an antenna grid formed on a vehicle window of the vehicle, said antenna grid including a plurality of antenna elements that extend substantially across the width of the window, said antenna grid further including first and second antenna end bus bars connecting the antenna elements at opposite ends;

a defogger grid formed on the vehicle window, said defogger grid including a plurality of defogger elements that extend substantially across the width of the window, said defogger grid further including first and second defogger end bus bars connecting the defogger elements at opposite ends; and a first grounding strip formed on the vehicle window adjacent to the first defogger end bus bar and defining an RF slot between the first defogger bus bar and the first grounding strip, said grounding strip being capacitively coupled to a vehicle body panel to provide an RF ground for the defogger grid.

2. The antenna system according to claim 1 further comprising an RF grounding line connected to the first grounding strip and one element of the defogger grid.

3. The antenna system according to claim 2 wherein the grounding line is connected to a lower element of the defogger grid opposite to the antenna grid.

4. The antenna system according to claim 2 wherein the grounding line has a length approximately equal to one-quarter the wavelength of the center frequency of the FM frequency band.

5. The antenna system according to claim 1 further comprising a second grounding strip formed on the vehicle window adjacent to the second antenna end bus bar, said second grounding strip creating a slot gap between the second grounding strip and the second end bus bar that defines an RF slot transmission line.

6. The antenna system according to claim 1 wherein the antenna grid and the defogger grid are formed on a rear window of the vehicle.

7. The antenna system according to claim 1 wherein the antenna grid is formed at an upper location of the window and the defogger grid is formed at a lower location of the window.

8. The antenna system according to claim 1 wherein the first grounding strip is capacitively coupled to the vehicle body panel through a urethane seal that seals the window to the body panel.

9. A backlite antenna system for a rear window of a vehicle, said rear window being mounted in an opening in a vehicle body panel, said antenna system comprising:

an antenna grid formed at an upper location of the rear window, said antenna grid including a plurality of antenna elements that extend substantially across the width of the rear window, said antenna grid further including first and second antenna end bus bars connecting the antenna elements at opposite ends;

a defogger grid formed on a lower location of the rear window, said defogger grid including a plurality of defogger elements that extend substantially across the width of the window, said defogger grid further including first and second defogger end bus bars connecting the defogger elements at opposite ends;

a first grounding strip positioned between the first defogger end bus bar and a first edge of the rear window and defining an FM slot gap therebetween, said first grounding strip being capacitively coupled to the vehicle body panel to provide an AM ground for the defogger grid; and an AM grounding line connected to the first grounding strip and one element of the defogger grid, said first grounding strip and said grounding line also providing an AM ground for the defogger grid.

10. The antenna system according to claim 9 wherein the grounding line is connected to a lower element of the defogger grid opposite to the antenna grid.

11. The antenna system according to claim 9 wherein the grounding line has a length approximately equal to one-quarter the wavelength of the center frequency of the FM frequency band.

12. The antenna system according to claim 9 further comprising a second grounding strip formed on the vehicle window adjacent to the second defogger end bus bar, said second grounding strip creating a slot gap between the second grounding strip and the second end bus bar that defines an FM slot transmission line.

13. The antenna system according to claim 9 wherein the first grounding strip has a length approximately equal to the first defogger and the bus bar.

14. A method of providing an AM ground for an antenna system in a vehicle, said method comprising the steps of:

forming an antenna grid on a vehicle window of the vehicle that include a plurality of antenna elements extending substantially across the width of the window where the antenna elements are connected at each end by opposing first and second antenna end bus bars;

forming a defogger grid on the vehicle window separate from the antenna grid that includes a plurality of defogger elements extending substantially across the width of the window where the defogger elements are connected at both ends by opposing first and second defogger end bus bars;

forming a first grounding strip on the window adjacent to the first defogger bus bar to form a slot gap therebetween; and capacitively coupling the first grounding strip to the vehicle body panel through a seal that seals the window to the body panel.

15. The method according to claim 14 further comprising the step of connecting an AM grounding line to the first grounding strip and one element of the defogger grid.

16. The method according to claim 15 wherein the step of connecting the AM grounding line includes connecting the AM grounding line to a lower element of the defogger grid opposite to the antenna grid.

17. The method according to claim 14 further comprising the step of forming a second grounding strip on the vehicle window adjacent to the second defogger end bus bar to define an FM slot gap between the second defogger bus bar and the second grounding strip.

* * * * *